US009963845B2

(12) United States Patent
Fege et al.

(10) Patent No.: US 9,963,845 B2
(45) Date of Patent: May 8, 2018

(54) RAIL VEHICLE COMPRISING SNOW PLOW

(71) Applicant: SIEMENS AKTIENGESELLSCHAFT, Munich (DE)

(72) Inventors: Alexander Fege, Augsburg (DE); Joerg Melde, Olching (DE); Joachim Meyer, Munich (DE); Joerg Pforr, Moosach (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days. days.

(21) Appl. No.: 15/122,211

(22) PCT Filed: Feb. 6, 2015

(86) PCT No.: PCT/EP2015/052471

§ 371 (c)(1),
(2) Date: Aug. 29, 2016

(87) PCT Pub. No.: WO2015/128166

PCT Pub. Date: Sep. 3, 2015

(65) Prior Publication Data

US 2016/0369464 A1 Dec. 22, 2016

(30) Foreign Application Priority Data

Feb. 28, 2014 (DE) ..... 10 2014 203 734

(51) Int. Cl.
*E01H 5/06* (2006.01)
*B61F 19/04* (2006.01)
(Continued)

(52) U.S. Cl.
CPC ..... *E01H 5/061* (2013.01); *B61F 19/04* (2013.01); *B61F 19/06* (2013.01); *E01H 8/04* (2013.01)

(58) Field of Classification Search
CPC ..... E01H 5/061; E04H 8/04
See application file for complete search history.

(56) References Cited

U.S. PATENT DOCUMENTS 51,829 A 1/1866 Heywood
289,705 A 12/1883 Phillips
(Continued)

FOREIGN PATENT DOCUMENTS

DE 19933914 A1 1/2001
DE 19933915 A1 1/2001
(Continued)

*Primary Examiner* — Tara Mayo-Pinnock
(74) *Attorney, Agent, or Firm* — Laurence Greenberg; Werner Stemer; Ralph Locher

(57) ABSTRACT

A rail vehicle has a vehicle body supported in a sprung fashion on bogies. A snow plow has two blade plates that run to a point and a plow blade arranged vertically adjustably behind the blade plates. A projecting portion of the plow blade that projects downwards beyond a lower edge of the blade plates is adjustable. The blade plates rest with their lower edge on a base plate which forms a cutting edge that protrudes from the lower edge in the direction of travel. The snow plow is attached to an under frame of the vehicle body such that the base plate maintains a safety distance from the travel rails. The safety distance is predefined by a maximum spring compression of the vehicle body. The protruding portion of the plow blade is set as a function of the safety distance and of a wear of the wheels of the bogies.

7 Claims, 2 Drawing Sheets

(51) Int. Cl.
*E01H 8/04* (2006.01)
*B61F 19/06* (2006.01)

(56) References Cited

U.S. PATENT DOCUMENTS

| | | | |
|---|---|---|---|
| 345,257 | A | 7/1886 | Priest |
| 517,478 | A | 4/1894 | Olson |
| 1,207,789 | A | 12/1916 | Packer |
| 1,518,685 | A | 12/1924 | Berczik |
| 6,688,021 | B2 | 2/2004 | Baig et al. |

FOREIGN PATENT DOCUMENTS

| | | | |
|---|---|---|---|
| DE | 102009019576 | A1 | 11/2010 |
| EP | 1070792 | A2 | 1/2001 |
| JP | H10252030 | A | 9/1998 |
| RU | 2081018 | C1 | 6/1997 |

RAIL VEHICLE COMPRISING SNOW PLOW

BACKGROUND OF THE INVENTION

Field of the Invention

The invention relates to a rail vehicle, in particular a locomotive, with a vehicle body which is supported in a sprung fashion on bogies that can travel along running rails, and a snow plow which has two blade plates that run to a point in a plow shape and have a C-shaped profile, and with a plow blade that is arranged in a vertically adjustable fashion behind the blade plates in the direction of travel, and whose projecting portion, which projects downward beyond a lower edge of the blade plates, is adjustable. The blade plates rest with their lower edge on a base plate, which forms a cutting edge that protrudes from the lower edge in the direction of travel.

It is known for rail vehicles, in particular locomotives, to be fitted with snow plows, in order to clear snow of different thickness from the route up to a maximum height of 800 mm to 1000 mm above the running rails at running speeds of over 100 km/h, where possible up to 160 km/h, without risk of derailment.

From patent publication EP 1 070 792 B1 a rail vehicle is known, in particular a locomotive with a supporting frame and a track cleaner. The track cleaner has two C-shaped profiled plow blades which run to a point and are arranged in a plow shape. The plow blades are fastened to the supporting frame by way of brackets, the deformations of which are kept essentially parallel to the plane of the supporting frame in the event of an impact load. In a collision this thereby reduces firstly the risk of damage to the supporting frame and secondly the risk of a derailment due to a track cleaner being bent downward or being ruptured.

The patent publication JP 10252030 A discloses a rail vehicle for snow clearance, comprising a multiple plow device with a frame which is connected to the rail vehicle by way of a shaft with a vertical axis of rotation, as well as a lower plow device which is supported by a lifting device. The lifting device is connected to the frame behind the multiple plow device. The plow blades of the multiple plow device can, in order to clear the snow above the tops of the rails, be brought into a V-shaped position, a straight position or a reverse V-shaped position. A V-shaped lower plow of the lower snow plow device clears the snow below the tops of the rails between two running rails. The lower plow has a guide surface for conveying snow away in a horizontal direction, which stops snow from falling down between the running rails.

U.S. Pat. No. 6,688,021 B2 shows a locomotive with a snow plow and a device for improved snow clearance, which further removes snow left behind by the snow plow. As a result, traction and control of the locomotive are improved. For each running rail the device comprises a clearance flap which projects downward beyond the bottom edge of the snow plow. The clearance flaps loosen and remove residual snow, as well as other debris, left by the snow plow. The device handily removes snow while being constructed of the thinnest material possible.

Known from U.S. Pat. No. 51,829 A is a snow plow for rail vehicles for removing snow and ice from the running rails and from the track bed. The snow plow comprises a vertically and laterally self-adjustable pusher, two movable side wings for removing snow and ice and a spring arm for maintaining a distance between pusher and running rails, in order not to impede the operation of the snow plow because of obstacles.

Published patent application DE 10 2009 019 576 A1 shows a swept-back snow plow with two lateral surfaces for a rail vehicle. In order to configure this kind of snow plow in a fluidically favorable manner, perforations are present in the lateral surfaces. The perforations are provided with guide vanes which are arranged and embodied such that the air flow is deflected downward.

Published patent application DE 199 33 914 A1 discloses a track cleaner for a rail vehicle, which consists of one or more plow blades which are fastened to the supporting frame of the rail vehicle with a bracket. The problem when fastening the track cleaner, which extends over the entire width of the rail vehicle, is that fastening points which are far apart need to be provided, and require a high level of manufacturing precision and a great deal of effort during installation. To create a track cleaner which is easy to manufacture and to mount, a bracket is proposed for the track cleaner which consists of a torsion-resistant support structure which is fastened by its upper end centrally to the buffer beam and by its lower end to the plow blade.

From published patent application DE 199 33 915 A1 a track cleaner for a rail vehicle is known which consists of one or more plow blades which are fastened to the supporting frame of the rail vehicle with a bracket. To lessen the risk of the track cleaner buckling downward in a collision with an obstacle and causing the rail vehicle to derail, and in the event of a deformation of the bracket of the track cleaner to prevent the supporting frame from also being deformed, it is proposed to configure the bracket such that, in a collision with an obstacle, energy is absorbed by energy dissipation elements arranged in the bracket and the track cleaner is kept essentially parallel to the plane of the supporting frame.

When fastening a snow plow to the underframe of the rail vehicle there is a conflict of objectives regarding the free gap between a lower edge of the snow plow and an upper edge of the running rails. On the one hand, the gap height should maintain at least a safety distance resulting from relevant restriction calculations, taking account of pitching and lifting movements of the vehicle body, to prevent the snow plow from striking the running rails. On the other hand the calculated safety distance may prove to be so large, for example larger than 200 mm, that obstacles such as wooden sleepers pass through the gap and cannot be cleared away by the snow plow, and components arranged behind the snow plow, such as antennas, sanding equipment or the like, are inadequately protected.

BRIEF SUMMARY OF THE INVENTION

The basic task of the invention is hence to provide a generic rail vehicle with a snow plow, wherein the gap between snow plow and running rails can be better adjusted.

The object is achieved by a rail vehicle of the type cited in the introduction with the features as claimed. Thus a rail vehicle, in particular a locomotive, comprises a vehicle body which is supported in a sprung fashion on bogies that can travel along running rails. It further comprises a snow plow which has two blade plates which run to a point in a plow shape, and have a C-shaped profile and with a plow blade which is arranged in a vertically adjustable fashion behind the blade plates in the direction of travel, and whose projecting portion, which projects downward beyond a lower edge of the blade plates, is adjustable. The blade plates rest with their lower edge on a base plate, which forms a cutting edge which protrudes from the lower edge in the direction of travel. According to the invention the snow plow is attached to an underframe of the vehicle body such that the base plate of the snow plow maintains a safety distance from the running rails, which safety distance is predefined by maximum spring compression of the vehicle body, wherein the protruding portion of the plow blade is set as a function of the safety distance and of wear of the wheel tires of rail wheels of the bogies.

When a rail vehicle is in motion the cutting edge divides the snow lying on the track into an upper layer of snow and a lower layer of snow remaining on the track for the time being. The upper layer of snow then ends up on the rising C-arm of the blade plates and is lifted by them, so that the load on the leading wheelset of a bogie of the rail vehicle is not reduced and said leading wheelset stays in the running rails without risk of derailment. Because of the way the lifted layer of snow planes in the C-shaped profiled blade plates it is rotated and thanks to the sweep of the blade plates it is thrown helically outward next to the track. The large-area blade plates form a first clearance stage for deep snow and larger obstacles, while the small-area plow blade forms a second clearance stage for smaller obstacles not caught by the first clearance stage. While the first clearance stage can be permanently mounted at a safe height above the top of the rails, in order to be able to transmit high forces onto the underframe the operator of the rail vehicle can set the gap height by adjusting the protruding portion of the plow blade, in particular can set it so small that components arranged behind the snow plow are adequately protected. Since the single- or multi-part plow blade, for example arranged so as to sweep back, is a component representing a comparatively small portion of the total weight of the snow plow of over 400 kg, the gap height can also easily be set without mechanical assistance. The snow plow can be fastened such that when wheel tires are worn and when all possible pitching and lifting motions of the vehicle body are taken into account the blade plates have a predefinable safety distance from the top of the rails. Thus the blade plates are arranged too high most of the time. So that components such as antenna equipment or sanding systems are also adequately protected, the gap between the top of the rails and the snow plow is reduced, by enlarging the protruding portion of the downwardly protruding plow blade.

In a preferred embodiment of the inventive rail vehicle a deflection web projecting in the direction of travel is integrally formed on an upper edge of the blade plates. The deflection web deflects the snow planing as far as the upper C-arm end of a blade plate forward and reduces the amount of snow thrown up from the blade plates onto a front window pane of a driver's cab of the rail vehicle.

In an advantageous embodiment of the inventive rail vehicle the blade plates are connected to a rear wall extending transversely to the direction of travel via a plurality of reinforcing ribs extending in the direction of travel. The snow plow is thus embodied as an intrinsically rigid structure and has no defined energy absorption properties. If the snow plow absorbs energy this could result in its being destroyed or ruptured, thereby allowing obstacles to develop which could lead to the rail vehicle being derailed if it runs over them.

In an advantageous embodiment the inventive rail vehicle comprises buffer elements arranged on the front of the underframe, which are designed to absorb impact energy through elastic compression of a buffer spring along a reversible, first energy absorption path. The buffer elements are connected to the underframe via deformation elements, which are designed to absorb impact energy through plastic deformation of a deformation structure along a non-reversible, second energy absorption path. The snow plow is fastened to the underframe such that its point lies behind the first and second energy absorption paths in the direction of travel. This means that in the case of rail vehicles with this kind of collision management system the snow plow is kept out of the energy absorption paths. Nevertheless the snow plow ensures that collision partners or obstacles lying on the track are cleared from the running rails, without falling under the rail vehicle itself, with the associated critical risks of derailment.

Preferably the inventive rail vehicle comprises lifting points arranged laterally on the underframe for a lifting device, wherein the blade plates of the snow plow encompass an obtuse point angle such that lateral outer edges of the blade plates terminate behind the lifting points in the direction of travel. Thus the snow plow does not have to be dismantled if the rail vehicle has to be lifted—for example for railing or rerailing. In contrast to the known point-angled sweeps of snow plows the point angle is preferably designed to be obtuse, for example between 100° and 120°, in order to keep the point of the snow plow out of the energy absorption path.

In an advantageous embodiment the inventive rail vehicle comprises an antenna device arranged behind the snow plow, wherein a bracket is arranged on the rear wall of the snow plow so as to cover the antenna device from above. Thanks to the integrated bracket additional protection of the antenna device against external mechanical damage is provided.

In a preferred embodiment the inventive rail vehicle comprises a coupling element arranged on the front of the underframe, wherein the snow plow has a recess in the region of the point, through which the coupling element is guided. The recess can be formed in that centrally arranged inner edges of the blade plates do not abut one another, or in that blade plates arranged centrally edge-to-edge for example have a rectangular cutout. Thus in the case of a mounted snow plow a coupling element designed as a screw coupling can spring backward or the coupling head of a coupling element designed as a central buffer coupling can be replaced.

BRIEF DESCRIPTION OF THE SEVERAL VIEWS OF THE DRAWING

Further attributes and advantages of the invention emerge from the following description of a concrete exemplary embodiment based on the drawings, in which.

DESCRIPTION OF THE INVENTION

Figure 1:
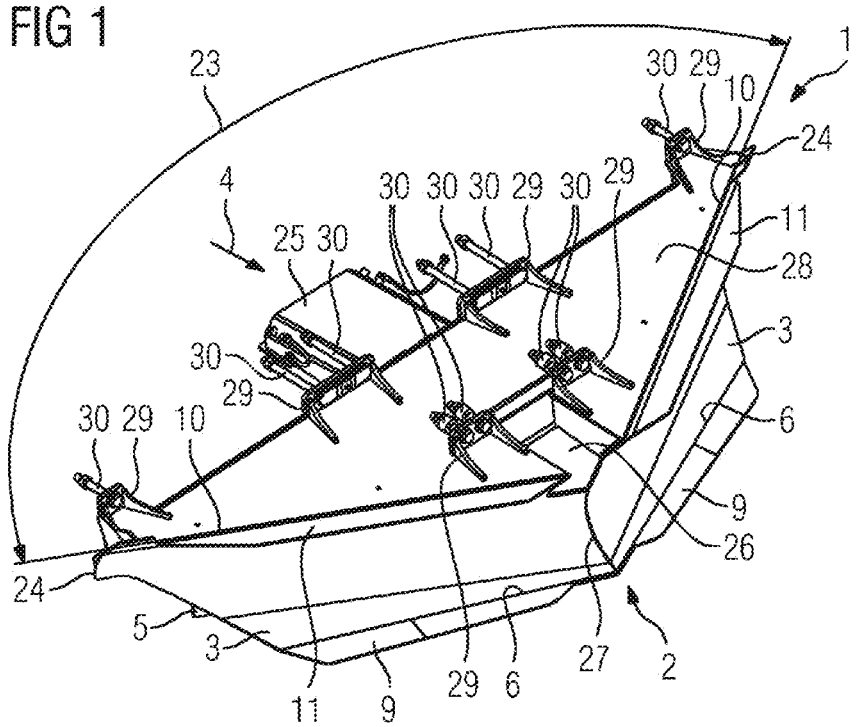
FIG. 1 shows a perspective view from above of a snow plow of an inventive rail vehicle.
Figure 2:
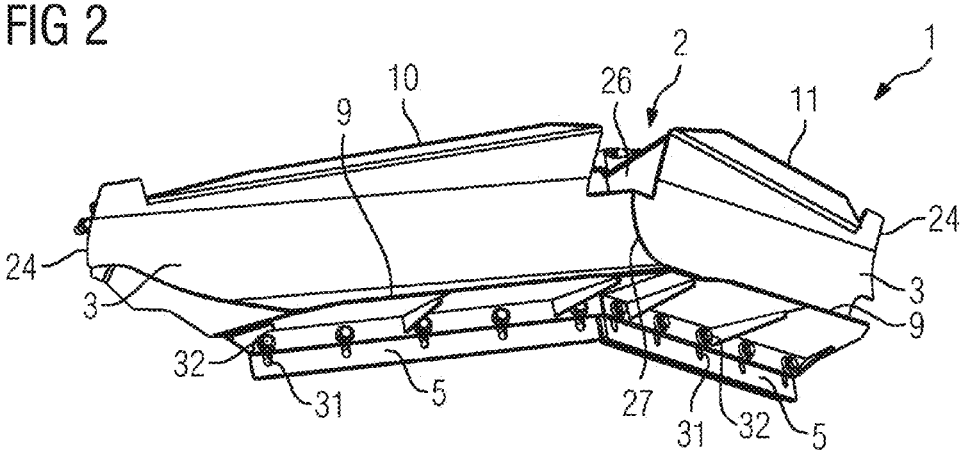
FIG. 2 shows a perspective view from below of the snow plow according to FIG. 1.
Figure 3:
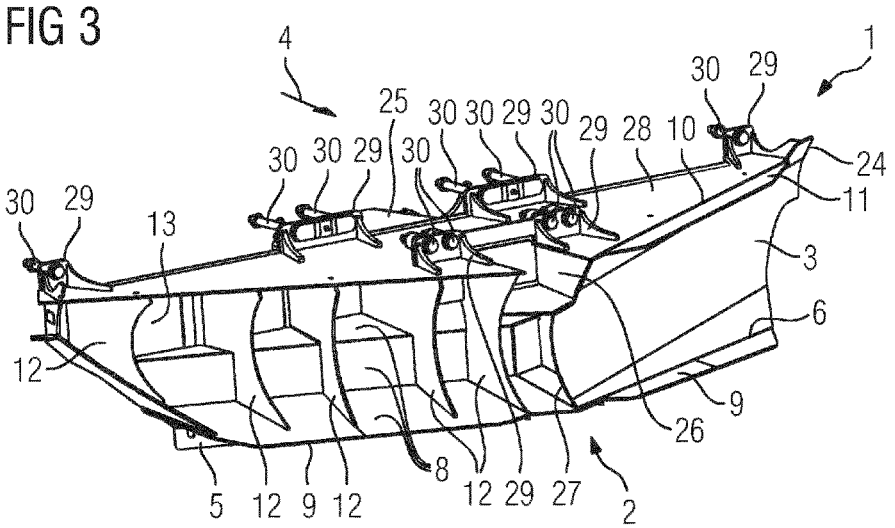
FIG. 3 shows the snow plow according to FIG. 1 with a blade plate (not shown) and FIG. 4 shows a schematic side view of the front of an inventive rail vehicle with mounted snow plow.

According to FIG. 1 to FIG. 4 a snow plow 1 comprises, for an inventive rail vehicle 14, in particular for a locomotive, two plow-shaped blade plates 3 running to a point 2, which form a first clearance stage. The blade plates 3 have a C-shaped profile and are arranged in a swept-back manner such that their concave front sides point in the direction of travel 4 of the rail vehicle 14. The straight lower edges 6 of the blade plates 3 lie on a base plate 8 of the snow plow 1, wherein the base plate 8 forms a cutting edge 9 projecting from the lower edges 6 in the direction of travel 4. A deflection web 11 projecting in the direction of travel 4 is integrally formed on an upper edge 10 of the blade plates 3. The blade plates 3 arranged so as to sweep back encompass an obtuse point angle 23 which lies in the range between 110° and 120°. At the point 2 both the blade plates 3 abut one another and form a common nose cutting edge 27. At their upper edges 10 the blade plates 3 are cut out in the region of the point 2, in order to form a central recess 26. The snow plow 3 has a rear wall 13 extending transversely to the direction of travel 4, which is connected to the blade plates via a plurality of laminar reinforcing ribs 12 extending in the direction of travel 4. According to FIG. 3 the reinforcing ribs 12 have a front edge following the convex C-profile of the rear sides of the blade plates 3 and a rectangular corner cutout, in order to match the stepped course of the base plate 8. According to the invention the snow plow 1 comprises a vertically adjustable plow blade 5 which is arranged behind the blade plates 3 in the direction of travel 4, for example on the step of the base plate 8. The plow blade 5 is arranged in a swept-back manner and has a series of vertical elongated holes 31, through which it is connected to the base plate 8 in a vertically adjustable manner by means of fastening screws 32. A protruding portion 7 of the plow blade 5 projecting beyond a lower edge 6 of the blade plates 3 is thereby adjustable. The plow blade 5 forms a second clearance stage which is arranged downstream of the first clearance stage and has an adjustable gap height 17 from running rails 15 traversed by the rail vehicle 14. A cover plate 28 lies on the upper edges of the reinforcing ribs 12, so that the snow plow 1 represents an intrinsically rigid structure in the form of a closed box. Arranged on the rear wall 13 of the snow plow 1 is a laminarly formed bracket 25, which projects horizontally backward. Also arranged on the rear wall 13 is a mounting base 29 for screw connections 30 for fastening the snow plow 1 to the rail vehicle.

During snow clearance by the rail vehicle in service the cutting edge 9 of the base plate 8 divides the snow to be cleared into an upper layer of snow and a lower layer of snow. The upper layer of snow is lifted by the C-shaped profiled blade plates 3 of the first clearance stage and is made to rotate by planing on the C-profile of the blade plates 3, until it is deflected forward by the deflection web 11; at the same time the rotating snow is guided away laterally outward by the sweep of the blade plates 3. The plow blade 5 of the downstream, second clearance stage clears at least some of the lower layer of snow from the track, as well as smaller obstacles which were not caught by the first clearance stage.

Figure 4:
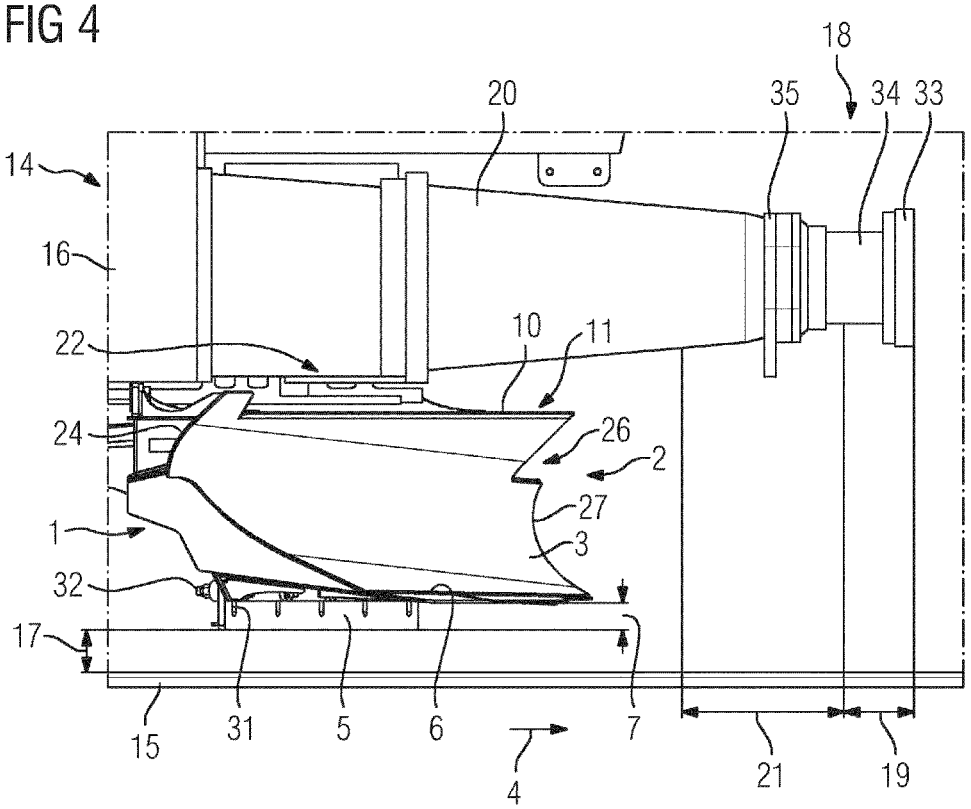

According to FIG. 4 the snow plow 1 is fastened to an underframe 16 of a vehicle body (not shown) of the rail vehicle 14. The vehicle body is supported via secondary suspension on bogies (likewise not shown) that can travel along running rails 15. The bogies have bogie frames which in turn are supported via primary suspension on wheelsets having rail wheels. Because of the primary and secondary suspension the vehicle body—and with it the rigidly fastened snow plow 1—in particular executes lifting motions along a vehicle vertical axis and pitching motions about a vehicle transverse axis. The snow plow 1 is now fastened to the underframe 16 such that the base plate 8 maintains a safety distance from the running rails 15 predefined by maximum spring compression of the vehicle body, wherein the protruding portion 7 of the plow blade 5 and thus the gap height 17 is set as a function of the safety distance and of wear of the wheel tires of the rail wheels.

The rail vehicle 14 comprises buffer elements 18 arranged on the front of the underframe 16, which are designed to absorb impact energy through elastic compression of a buffer spring (not shown) along a reversible, first energy absorption path 19. A buffer element 18 comprises a buffer head 33, which is attached at the front end of a plunger 34. The plunger 34 can be plunged in the direction of travel 4 against the buffer spring in a buffer receptacle 35. The buffer elements 18 are connected to the underframe 16 via deformation elements 20, which are designed to absorb impact energy through plastic deformation of a deformation structure along a non-reversible, second energy absorption path 21. The deformation structure can be designed in the shape of a truncated pyramid and in the event of a collision is compressed in a controlled manner, forming a series of transverse folds. In order not to interfere with the collision management system consisting of buffer elements 18 and deformation elements 20, the snow plow 1 is fastened to the underframe 16 such that the point 2 lies behind the lined-up energy absorption paths 19 and 21 in the direction of travel 4. The rail vehicle 14 comprises lifting points 22 for a lifting device (not shown) arranged laterally on the underframe 16. So that the lifting points 22 are freely accessible without dismantling the snow plow 1, the blade plates 3 of the snow plow 1 encompass an oblique point angle 23 of for example 115°, so that lateral outer edges 24 of the blade plates 3 terminate behind the lifting points 22 in the direction of travel 4. The rail vehicle 14 comprises an antenna device (not shown) which is arranged centrally behind the snow plow 1 and which is covered from above by the bracket 25. The rail vehicle 14 comprises a coupling element (not shown) which is arranged on the front of the underframe 16 and which is guided through the recess 26 arranged in the upper region of the point 2 of the snow plow 1.

The invention claimed is:

1. A rail vehicle, comprising:

a vehicle body supported in sprung fashion on bogies having rail wheels with wheel tires configured to travel along running rails, said vehicle body having an underframe;

buffer elements arranged on a forward end of said underframe and configured for absorbing impact energy through elastic compression of a buffer spring along a first energy absorption path, and deformation elements connecting said buffer elements to said underframe and configured for absorbing impact energy through plastic deformation of a deformation structure along a second energy absorption path a snow plow mounted to said underframe, said snow plow having:

two blade plates running to a point in a plow shape, said blade plates having a C-shaped profile and a lower edge, said snow plow being fastened to said underframe so that said point lies behind said first and second energy absorption paths in the direction of travel;

a plow blade mounted behind said blade plates in a direction of travel of the rail vehicle, said plow blade being vertically adjustable and projecting downward beyond a lower edge of said blade plates with an adjustable projecting portion;

a base plate forming a cutting edge that protrudes forward from said lower edge of said blade plates in the direction of travel, said blade plates resting with said lower edge on said base plate;

said snow plow being fastened to said underframe of said vehicle body so that said base plate of said snow plow maintains a safety distance from the running rails, the safety distance being predefined by a maximum spring compression of the vehicle body, and said adjustable projecting portion of said plow blade being set in dependence on the safety distance and on a wear of said wheel tires of said rail wheels of said bogies.

2. The rail vehicle according to claim 1, wherein the rail vehicle is a locomotive and said snow plow is mounted to a forward end of said locomotive.

3. The rail vehicle according to claim 1, which comprises a deflection web integrally formed on an upper edge of said blade plates and projecting in the direction of travel.

4. The rail vehicle according to claim 1, which comprises a plurality of reinforcing ribs extending in the direction of travel and connecting said blade plates to a rear wall extending transversely to the direction of travel.

5. The rail vehicle according to claim 1, comprising lifting positions arranged laterally on said underframe for a lifting device, wherein said blade plates of said snow plow enclose an oblique point angle so that lateral outer edges of said blade plates terminate behind said lifting positions in the direction of travel.

6. The rail vehicle according to claim 1, comprising an antenna device arranged behind said snow plow, and a bracket arranged on a rear wall of said snow plow and disposed to cover said antenna device from above.

7. The rail vehicle according to claim 1, comprising a coupling element arranged on a front of said underframe, and wherein said snow plow is formed with a recess in the region of said point, through which said coupling element is guided.

* * * * *